United States Patent [19]

Oger

[11] 4,065,932

[45] Jan. 3, 1978

[54] CASING VOUSSOIR AND METHOD FOR PRODUCING THE VOUSSOIR

[75] Inventor: Jacques François Oger, Pont a Mousson, France

[73] Assignees: Sogelerg, Chevilly-Larue; Setec Travaux Publics, Paris Cedex, both of France

[21] Appl. No.: 749,259

[22] Filed: Dec. 10, 1976

Related U.S. Application Data

[63] Continuation of Ser. No. 577,790, May 14, 1975, abandoned.

[30] Foreign Application Priority Data

May 27, 1974 France ..... 74.18257

[51] Int. Cl.[2] ..... E21D 5/11; E01G 5/02

[52] U.S. Cl. ..... 61/45 R; 61/63; 52/601

[58] Field of Search ..... 61/45 R, 42, 84, 63; 52/601, 86, 224

[56] References Cited

U.S. PATENT DOCUMENTS

| | | | |
|---|---|---|---|
| 1,637,215 | 7/1927 | Coppock | 52/601 |
| 2,423,695 | 7/1947 | Falco | 52/601 |
| 3,319,386 | 5/1967 | Francis | 52/601 X |
| 3,389,560 | 6/1968 | Zemsky | 61/45 R |
| 3,760,540 | 9/1973 | Latoria et al. | 52/601 X |
| 3,831,335 | 8/1974 | Ary | 52/601 |

*Primary Examiner*—Dennis L. Taylor

*Attorney, Agent, or Firm*—Haseltine, Lake & Waters

[57] ABSTRACT

This casing voussoir is of the type comprising a metallic frame 1, 2, $3^a$, $3^b$, 9 and a mass 12 of concrete or other like material strong in compression and anchored to that frame, the assembly having the shape of a cylindrical ring sector, characterized in that the frame 1, 2, $3^a$, $3^b$, 9 comprises two plates 1, 2, arranged along radial faces of the voussoir and interconnected by bars $3^a$, $3^b$, constituted by distinct parts of these plates 1, 2 and fixed to these latter by means of a filler material 8. A particular applications can be found for this voussoir in the lining of tunnels or similar underground works.

6 Claims, 4 Drawing Figures

CASING VOUSSOIR AND METHOD FOR PRODUCING THE VOUSSOIR

This is a continuation of application Ser. No. 577,790 filed May 14, 1975, now abandoned.

The present invention relates to a casing voussoir, in particular for lining tunnels and like underground works of the type comprising a metal frame and a mass of concrete or like material strong in compression anchored to the frame, the assembly having the shape of a cylindrical ring sector.

An object of the invention is to provide a voussoir of this type which is easily adaptable to the required circumferential dimensions in each particular case, irrespective of variations in these dimensions due to manufacturing tolerances such as those met with in the foundry.

According to the invention, there is provided a voussoir of the aforementioned type wherein the frame comprises two plates disposed along axial radial faces of the voussoir and interconnected by circumferential bars constituted by parts which are separate from the plates and fixed to the plates by a filler material.

According to another feature of the invention, the bars are so dimensioned as to transfer to the plates the compressive forces applied to the voussoir. This arrangement enables the thickness of the concrete, and consequently the rigidity of the lining, to be reduced and therefore enables the voussoir to perform under optimum conditions in compression while it has minimum volume, which for example decreases the volume of material which has to be removed when boring the tunnel.

Another object of the invention is to provide a method for producing such a voussoir having a frame, plates and distinct bars, comprising placing in position on a jig first the plates and then the bars, fixing the plates and bars together by means of said filler material and placing the mass of concrete in position.

With this method, it is possible to produce a single element, if necessary of large size, with precise dimensions based on a single voussoir constituted by a limited number of different parts which may be merely moulded in the foundry and unmachined. This method also permits reducing the number of bolts, and in some cases even doing away with the bolts, and reducing the comsumption of product for taking up clearance and fitting to the desired dimensions when an element of large size is constructed by juxtaposing and fixing together a plurality of elementary voussoirs.

Further features and advantages will be apparent from the ensuing description with reference to the accompanying drawing in which.

Figure 1:
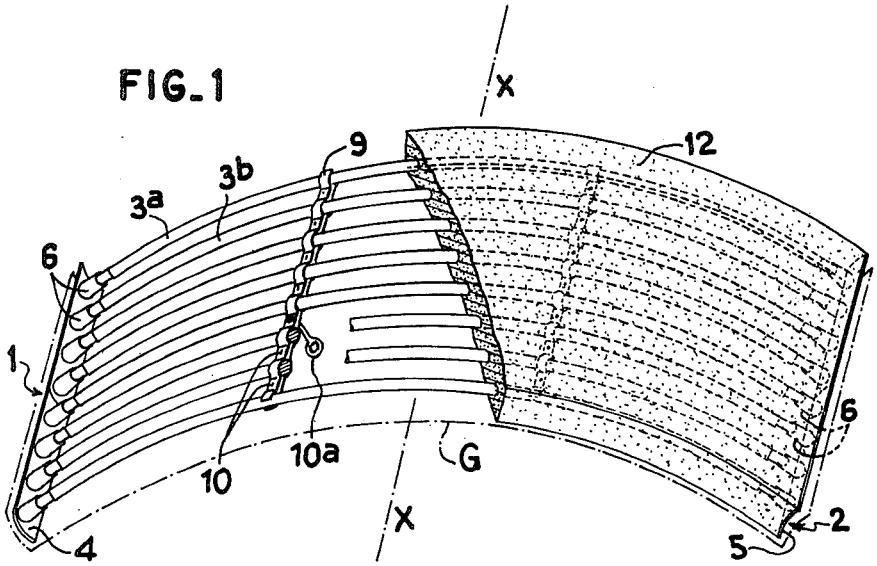
FIG. 1 is a perspective view of a casing voussoir according to the invention.
Figure 2:
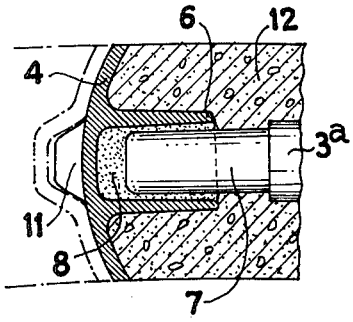
FIGS. 2 and 3 are enlarged diametral sectional views of two details of this voussoir.
Figure 3:
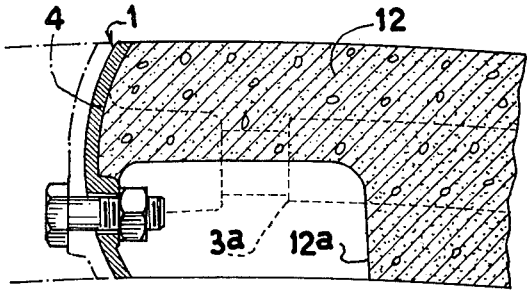

The casing voussoir shown in FIG. 1 has the shape of a sector of a cylindrical ring having an axis X—X and comprising two metal end plates 1 and 2 or longitudinal sides, for example of ductile cast iron, extending parallel to the axis X—X of the underground tunnel. The sides 1, 2 are interconnected by bent ductile cast iron bars $3^a$, $3^b$... having a circular or any other cross-sectional shape and constituting a cylindrical assembly having the same axis as the tunnel. The sides 1, 2 have preferably a generally curvilinear rectangular shape having two sides parallel to the axis X—X and two sides oriented on a diameter of the tunnel, the side 1 having a convex outer surface 4 and the side 2 a concave outer surface 5.

Each side 1, 2 comprises on its inner surface housings which are similar to cups and have a rather long lateral wall 6 of any shape, such as a cylindrical, frustoconical or other shape, and are cast with the corresponding metal plate. The bars $3^a$, $3^b$ have an end portion 7 of reduced section cooperating with the housings 6 but defining with the latter remaining gaps 8 which are filled with a filling and fixing material, such as an epoxy resin or the like.

The diameter of the bars is of the order of $\frac{1}{3}$ of the thickness of the voussoir and the distance between these bars is maintained by spacer means 9, for example constituted by pairs of steel corrugated section members of which one member extends on top of and the other under the bars, the members being interconnected by bolts 10.

The side 1 is advantageously provided with centering studs 11 and the side 2 with conjugate recesses and passages for the injection of a material for adhering the voussoirs together or sealing them or by the injection of a filler material outside the casing. Cavities $12^a$ are moreover provided in the mass of concrete 12 for a possible bolting together of the voussoirs.

Anchoring projecting portions 13 are provided on the inner surface of the plates 1, 2 for promoting the engagement of the concrete thereon.

Such a voussoir is assembled and placed in position in the following manner:

The metal sides 1, 2, cast in the foundry, are disposed on a jig G the dimensions of which correspond to those of the finished part. Thereafter, the filler material is introduced in the housings 6 and the bars $3^a$, $3^b$... are placed in position followed by their spacer members 9. The adaptation to the dimensions is achieved by means of the clearance remaining in the gap 8 between the end 7 of the bars 3 and the housing 6. The connecting material introduced in the gap 8 then permits the transmission of high compressive forces. In another embodiment, the bars 3 can be assembled with the sides 1, 2 by welding the ends 7 in the housings 6.

The metal part thus formed is then transported to the site where it is filled with a filler material 12, such as concrete, mortar or the like. The flowing of the concrete is limited by the sides in the circumferential direction and by either an inner or outer end wall. In order to facilitate handling before pouring the concrete, it is advantageous to replace some of the bolts 10 by hoisting rings $10^a$, only one of which is shown, with no danger of deforming the metal structure since the stresses are then strictly reduced to their minimum value.

By way of a modification, the metal frames may be placed directly in the tunnel itself by assembly thereof into a complete ring by making the convex surface 4 of one frame cooperate with the concave surface 5 of the immediately adjacent frame in the circumferential direction with no need to rapidly effect the filling with the concrete. Owing to the effect of the bars $3^a$, $3^b$ etc. good safety in the tunnel is ensured against the falling of blocks despite the absence of filling, the latter being carried out subsequently in situ in the known manner, for example by means of a sliding coffering.

Figure 4:
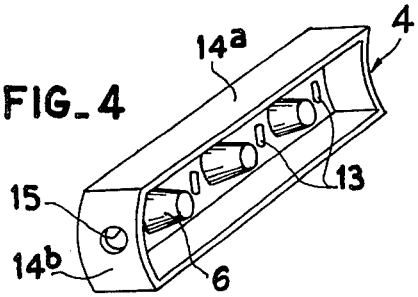
FIG. 4 is a partial perspective view of a modification of the voussoir according to the invention.

In the embodiment shown in FIG. 4, the edges of the mass of concrete are also protected by inner longitudinal flanges 14$^a$ and radial flanges 14$^b$ so that it is no longer necessary to employ binding reinforcements to preclude the rapture of the concrete owing to high contact pressures produced by the pressure loading of the lining. Indeed, the binding is here produced by the presence on the plates of, first, the housings 6 in which the bars are positioned and, secondly, the flanges 14$^a$, 14$^b$ which limit and reinforce the concrete in compression. If desired, the flanges 14$^b$ may have bolting apertures 15 for interconnecting the voussoirs in the longitudinal direction.

In a general way, the association of the metal sides 1, 2 and the flanges ensures an excellent protection of the voussoirs when handling and simplifies the coffering for the concreting.

Casing voussoirs of cast iron and concrete such as those described hereinbefore are capable of withstanding loads of the order of 500 to 1000 metric tons per linear meter.

What I claim is:

1. A casing voussoir comprising a metal frame and a mass of concrete anchored to the frame, said frame and mass of concrete having the shape of a sector of a cylindrical ring with radial end faces, said frame comprising two end plates disposed along said radial faces and circumferential bars embedded in the concrete and interconnecting said plates, said bars being separate from the plates and fixed on the plates by a fixing filler material distinct from the concrete, said plates having inner surfaces which receive the ends of the bars with interpostion of said filler material to insure a precise circumferential size of the voussoir, said plates and the ends of the bars forming a gap occupied by the filler material, said plates having inwardly protruding cup-shaped members, said bars having ends of a diameter substantially smaller than the internal diameter of the cup-shaped member to permit movement between the ends of the bars and the cup-shaped members prior to placement of the filler material and the concrete to obtain the precise circumferential size of the voussoir.

2. A voussoir according to claim 1, wherein the plates include flanges protecting the mass of concrete.

3. A voussoir according to claim 2 wherein said flanges extend longitudinally and radially.

4. A voussoir according to claim 1, wherein the plates have inner surfaces with projecting portions for anchoring the concrete.

5. A method for producing a casing voussoir of type having a metal frame comprising two plates disposed along axial radial faces of the voussoir having inwardly protruding cup-shaped members and circumferential bars separate from the plates and having ends of a diameter substantially smaller than the internal diameter of the cup-shaped members and fixed to the plates by a filler material, and a mass of concrete anchored to the frame and in which the bars are embedded, whereby the assembly has the shape of a sector of a cylindrical ring, said method comprising placing the plates in a position on a jig, inserting the end of the bars into the cup-shaped members while forming a gap therebetween to permit movement between the ends of the bars and the cup-shaped members to obtain a precise circumferential size of the voussoir, interconnecting the plates and the bars by injecting a fixing filler material into the gap formed between the ends of the bars and housing formed on the plate such that said precise circumferential size of the voussoir is made permanent, then placing the mass of concrete in position.

6. A method as claimed in claim 5, wherein said filler material is a weld material.

* * * * *